US005650866A

United States Patent [19]

Haslbeck

[11] Patent Number: 5,650,866

[45] Date of Patent: Jul. 22, 1997

[54] EYE GOGGLES

[75] Inventor: Joseph Haslbeck, West Vancouver, Canada

[73] Assignee: Sharp Plastics Manufacturing Ltd., Delta, Canada

[21] Appl. No.: 866,984

[22] Filed: Apr. 10, 1992

[51] Int. Cl.[6] ..... G02C 1/00; G02C 3/00; A61F 9/02

[52] U.S. Cl. ..... 359/43; 359/131; 359/156; 2/440; 2/443; 2/445; 2/452

[58] Field of Search ..... 351/124, 125, 351/126, 129, 130, 131, 133, 134, 142, 43, 156; 2/426, 428, 439, 440, 441, 442, 443, 444, 445, 446, 452

[56] References Cited

U.S. PATENT DOCUMENTS

| | | | |
|---|---|---|---|
| 1,146,549 | 7/1915 | Brayton | 2/440 |
| 1,666,407 | 4/1928 | Cook | 2/445 |
| 1,754,694 | 4/1930 | Neuwirth | 2/440 |
| 1,819,738 | 8/1931 | Daniels | 351/157 |
| 1,853,873 | 4/1932 | Meyrowitz | 2/445 |
| 1,916,628 | 7/1933 | Meyrowitz | 2/443 |
| 1,925,368 | 9/1933 | Bouchard | 88/43 |
| 1,938,924 | 12/1933 | Meyrowitz et al. | 2/445 |
| 1,986,089 | 1/1935 | Wingate | 351/156 |
| 2,051,544 | 8/1936 | Colliander | 351/133 |
| 2,973,690 | 3/1961 | Lindblum | 351/133 |
| 3,173,147 | 3/1965 | Gross et al. | 351/156 |
| 4,162,542 | 7/1979 | Frank | 2/15 |
| 4,264,987 | 5/1981 | Runckel | 2/428 |
| 4,348,775 | 9/1982 | Haslbeck | 2/452 |
| 5,042,934 | 8/1991 | Nakanishi | 351/124 |

FOREIGN PATENT DOCUMENTS

| | | | |
|---|---|---|---|
| 0561597 | 8/1958 | Canada | 2/443 |
| 0255262 | 2/1988 | European Pat. Off. . | |
| 3031279 | 3/1981 | Germany . | |
| 335939 | 4/1959 | Switzerland . | |

OTHER PUBLICATIONS

Speedo of California—1990 Catalogue—Model "Ultra Vision 1".

"PASHA—PS-001"—Tabata of Tokyo, Japan (prior to 1990).

TYR Sport Inc. of California—Models: "Alpha 1" & Ultra-max.

*Primary Examiner*—Ricky D. Shafer

[57] ABSTRACT

The invention provides a pair of goggles which can be used for a variety of recreational activities, such as swimming, cycling, ball games etc. The goggles comprise of a pair of eyepieces and a nosepiece. Each eyepiece has a lens and rim, each rim having a first connecting structure and a headstrap connecting structure to receive a headstrap. The nosepiece has a pair of second connecting structures, and a bridge structure disposed between and integral with the second connecting structure. Each second connecting structure is complementary to a respective first connecting structure of the pair of eyepieces and forms an essentially rigid interference fit therewith. Inner portions of the second connecting structure and outer portions of the bridge means are contiguous and inclined at respective angles to each other at a rigid joint which is sufficiently stiff to resist deformation when subjected to normal loads occurring during use. In this way, the angles between the second connecting structure and the outer portions of the bridge means remain essentially unchanged during normal use.

21 Claims, 4 Drawing Sheets

EYE GOGGLES

BACKGROUND OF THE INVENTION

The invention relates to eye goggles, in particular to a pair of eye goggles which can be used to protect the eyes in a wide variety of recreational activities, such as swimming, cycling, ball games, etc. where eye protection is usually worn.

In many recreational activities, it is prudent to wear eye protection, for example to protect the eyes from chemicals in pool water when swimming, from insects or road dirt during cycling, or from fast moving balls in ball games such as racquetball and squash. Other recreational activities requiring goggles include snow boarding, skiing, mountaineering, sailing etc. where additional protection from UV rays is required, as well as protection from wind-driven snow, rain, spray, etc. For the many activities mentioned above, separate prior art goggles would be required, each one being adapted for the specialized activity. To the inventor's knowledge, no prior art goggles exist which can be used for all the activities listed above. For example, when considering the first three activities only, the protective goggles used in ball games would be inappropriate for swimming as they would leak, and for cycling would probably be uncomfortable for long usage, and might be prone to permit entry of road dust. Prior art swimming goggles are inappropriate for cycling due to relatively poor peripheral vision and optical distortion. Prior art cycling goggles are not strong enough to prevent injury when impacted by a ball, and also are not waterproof for full immersion in water. Similar limitations exist for most specialized prior art goggles used in activities for which they were not designed.

In addition, a common problem with prior art swimming goggles relates to an interconnecting nosepiece which extends between eyepieces of the goggles. A common type of nosepiece is a relatively thin and flexible strap which is received within complementary openings provided in peripheral rims of the eyepieces. The strap has opposite outer ends provided with "barb-like" stepped projections which cooperate with the openings in the eyepieces to locate the nosepiece with respect to the eyepieces. The stepped projections at end portions of the nosepiece permit incremental adjustment of spacing between the eyepieces so as to accommodate persons having eyes at different widths. The flexibility of such straps is considered by some to be an advantage as it permits independent variations between the orientation of each eyepiece with respect to the nosepiece, so as to accommodate a wide variety of different shapes of faces. However, this flexibility is a disadvantage in that relatively high head-strap tension is required to locate and seal the goggles securely on the face, which tension can become uncomfortable if the goggles are worn for a long period of time. Furthermore, if the goggles are to be used when diving, even greater tension is required, which produces additional discomfort.

To avoid the above problems, some goggles have been produced with eyepieces which are interconnected and integral with the nosepiece, i.e. the eyepieces and nosepiece are fabricated in one piece from the same material. The nosepiece is relatively broad and provides a relatively rigid connection between the eyepieces, thus permitting reduction of head-strap tension while maintaining adequate sealing of the eyepieces with the wearer's face. However, fabricating the eyepieces and nosepiece of one type of material requires a compromise in the material characteristics. Clearly, the eyepieces are best selected for optical qualities, whereas the nosepiece material should be selected for toughness and strength. Usually, modern plastic materials do not exhibit the best of these two properties, and a poor compromise is reached in which the lens has relatively poor optical quality, and the nosepiece has poor toughness. This can result in relatively brittle goggles, which can break easily, or are too stiff to resiliently adapt to a face width. If the material has sufficient flexibility for the nosepiece requirement, the material would likely be a little soft for the eyepieces, which results in the eyepieces becoming easily scratched and with a reduction in optical quality.

SUMMARY OF THE INVENTION

The invention reduces the difficulties and disadvantages of the prior art by providing eye goggles which could be used for many of the recreational activities specified above, and are characterized by comfort, are waterproof when immersed in water, can be made resistant to UV rays and can provide adequate peripheral vision with good optical quality. Furthermore, the goggles are sufficiently strong with a sufficiently rigid nosepiece to withstand impact from hard balls and provide a good waterproof seal on the face with relatively low headstrap tension, thus being comfortable for diving and for long training swims. Furthermore, the goggles can be used for cycling, skiing, mountaineering, etc. as they provide more peripheral vision than prior art swim goggles and are comfortable to wear for long periods of time.

Eye goggles according to the invention comprise a pair of eyepieces and a nosepiece. Each eyepiece has a lens and a peripheral rim extending around the lens, each peripheral rim having a first connecting means and a head-strap connecting means to receive a head-strap. The nosepiece has a pair of second connecting means and a bridge means disposed between and integral with the second connecting means. Each second connecting means is complementary to a respective first connecting means of eyepieces. Inner portions of the second connecting means and outer portions of the bridge means are contiguous and are inclined at respective angles to each other at a rigid joint. The rigid joint is sufficiently stiff to resist deformation when subjected to normal loads occurring during use, so that the said angles between the second connecting means and the outer portions of the bridge means remain essentially unchanged during normal use.

Preferably, each second connecting means of the nosepiece is an essentially straight projection, and each first connecting means of the eyepieces is a socket means to receive the respective projection. The socket means is located in the peripheral rim of the respective eye piece. Also, each projection of the second connecting means has a projection inner portion and a projection outer portion disposed about a respective projection plane so as to be generally aligned with each other. Each outer portion of the bridge means has a width which is greater than width of the adjacent projection inner portion so as to provide an engaging shoulder to engage the peripheral rim of the eyepiece. The width of the outer portion and the width of the adjacent projection inner portion are measured parallel to the projection plane.

Also, preferably the goggles further include latch means for restricting separation of the bridge means from the eyepieces. The latch means resiliently co-operate with the second connecting means of the nosepiece and the first connecting means of the eyepieces. The bridge means has an engaging shoulder adapted to engage the peripheral rim of the eyepiece. The latch means includes a step located on the projection, and a latch shoulder extending into the socket means. The step and latch shoulder are engageable with each other when the projection is fully received in the socket means so as to hold the engaging shoulder against the peripheral rim of the eyepiece in an interference fit to augment retention of the projection A detailed disclosure following, related to drawings, describes a preferred embodiment of the invention which is capable of expression in structure other than that particularly described and illustrated.

DESCRIPTION OF THE DRAWINGS

The terms front, top, bottom, side etc. as used herein refer to portions of the goggles and orientation of the goggles on a wearer's face when the face is upright.

DETAILED DISCLOSURE

Figure 1:
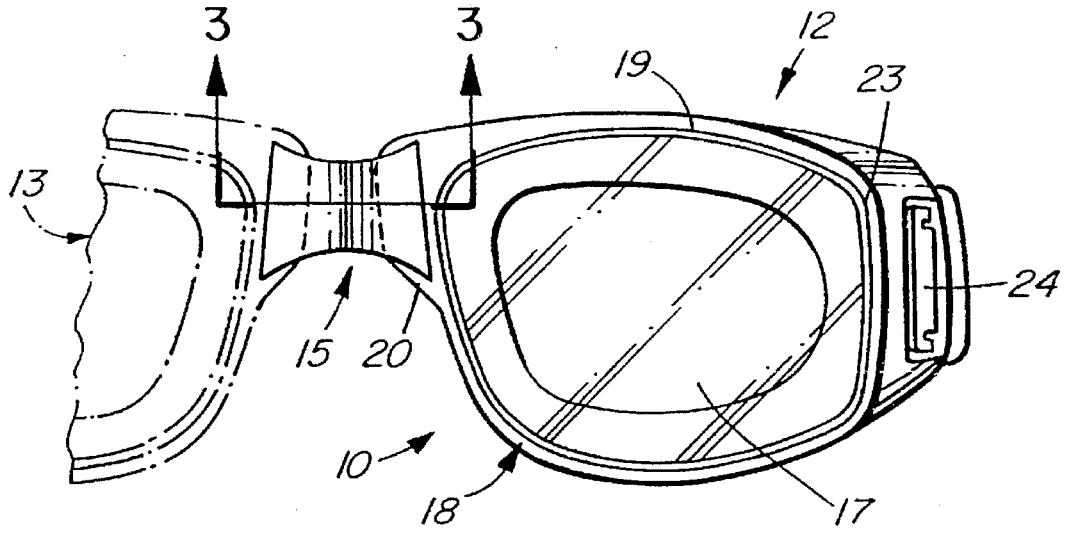
FIG. 1 is a simplified fragmented front elevation of goggles according to the invention, one eyepiece being shown fragmented in broken outline.
Figure 2:
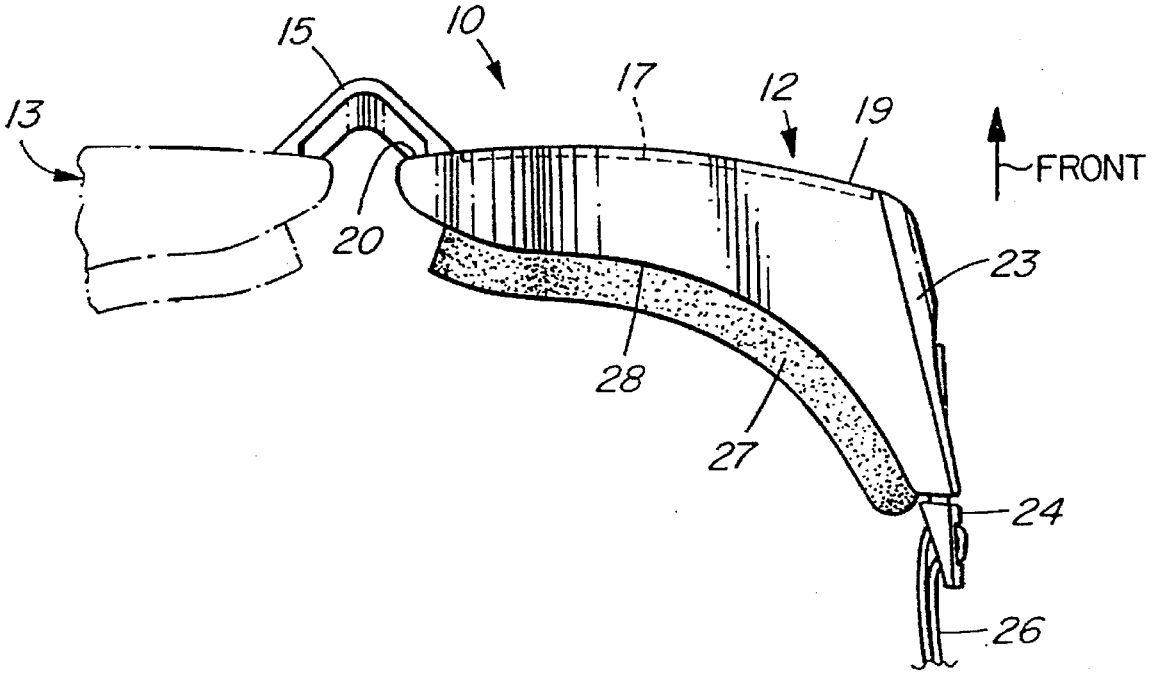
FIG. 2 is a simplified fragmented bottom plan of goggles according to the invention, one eyepiece being shown fragmented in broken outline.

FIGS. 1 and 2

Eye goggles 10 according to the invention comprise left and right eyepieces 12 and 13, and a nosepiece 15 interconnecting the eyepieces. The eyepiece 13 is generally similar to, but a mirror image of, the eyepiece 12, and thus only the eyepiece 12 will be described in detail. The eyepiece 12 has a transparent lens 17 and a peripheral rim 18 extending around the lens, the lens being adjacent an outer or front face 19 of the rim 18. The peripheral rim has an inner rim portion 20 adjacent and connected to the nosepiece 15, and an outer rim portion 23 oppositely spaced from the inner portion and provided with a head-strap connecting means 24.

A conventional head-strap 26 extends from the head-strap connecting means 24 on the eyepiece 12 to a similar head-strap connecting means, not shown, on the eyepiece 13 as is well known. To provide comfort for the wearer, foamed plastic padding 27 is secured to an inner or rear face 28 of the peripheral rim 18, which is on an opposite side of the rim 18 from the outer face 19.

The lens and portions of the peripheral frame of the eyepiece remote from the nose piece, and the head-strap and related connecting structure are known, and equivalent structures can be substituted. In contrast, the nosepiece, and means of connecting the nosepiece to the eyepieces is not found in prior art known to the inventor, and is described in greater detail with reference to FIGS. 3 through 7.

FIGS. 3 through 7

As previously stated, the eyepieces 12 and 13 are essentially similar to each other, and the means of connecting the eyepieces to the nosepiece 15 are also similar to each other, and thus only the connection between the nosepiece 15 and the left eyepiece 12 will be described in detail.

Figure 3:
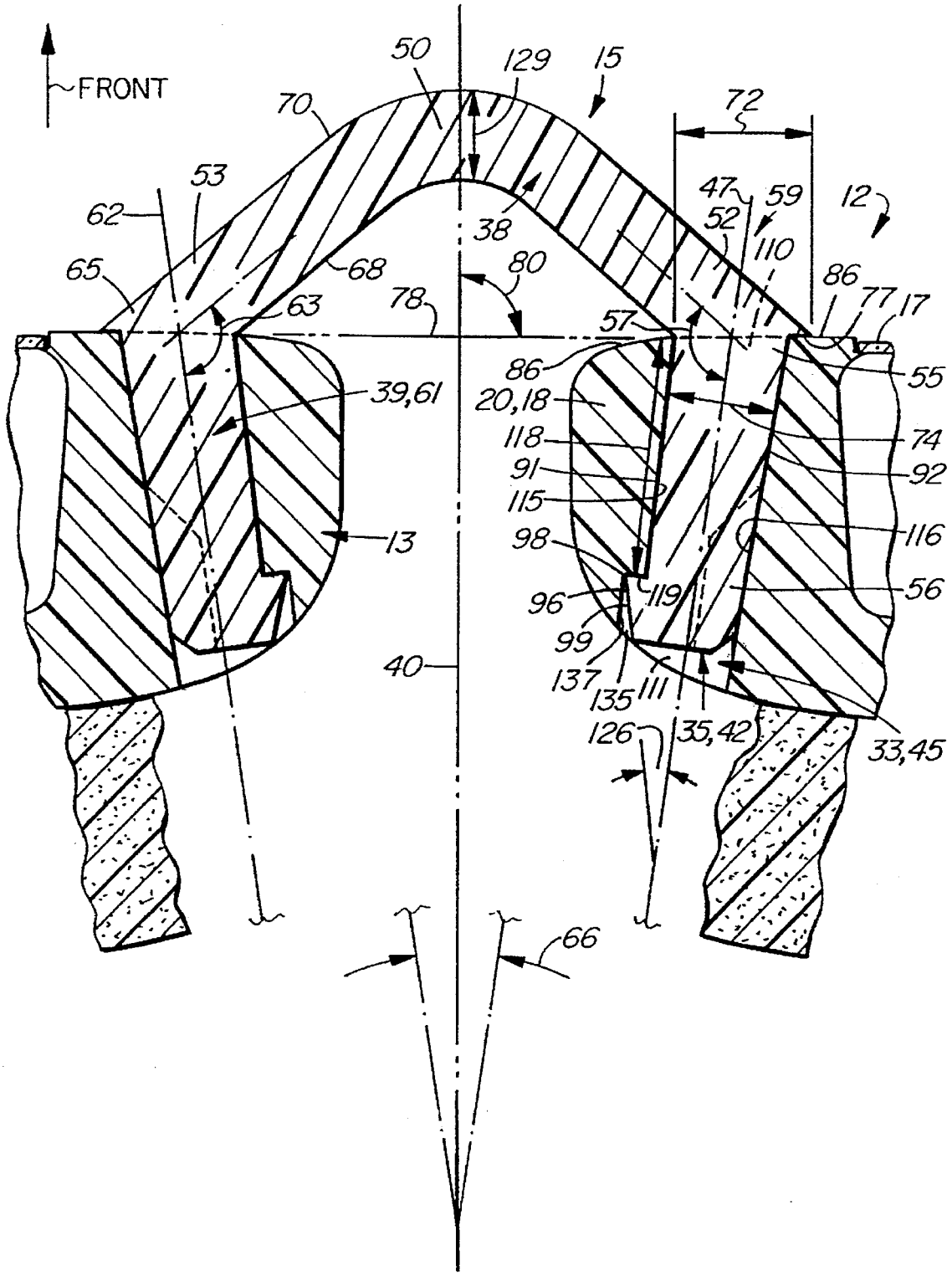
FIG. 3 is a simplified fragmented section generally on line 3—3 of FIG. 1, showing some details of connections between a nosepiece and eye pieces.

Referring mainly to FIG. 3, the inner rim portion 20 of the peripheral rim 18 of the left eyepiece 12 has a first connecting means 33, and the nose piece 15 has a left second connecting means 35 complementary to the first connecting means. The nosepiece also has a bridge means 38 which extends between the eyepieces 12 and 13. Also, the nosepiece has a right second connecting means 39 which is a mirror image of the left means 35 about a main plane of symmetry 40. Thus the nosepiece has a pair of second connecting means, 35 and 39, and a bridge means 38 disposed between and integral with the second connecting means. Each second connecting means is complementary to a respective first connecting means of the pair of eyepieces 12 and 13.

The second connecting means 35 is an essentially straight rectangular cross-sectioned projection 42, and the first connecting means 33 is a socket means 45 to receive the respective projection. The socket means is located in the peripheral rim 18 of the respective eyepiece, and a projection plane 47 extends generally along a coincident centerline of the projection and socket means which are interfitted closely as shown. The bridge means 38 has lower and upper edges 48 and 49 (FIG. 4) which define in part a U-shaped central portion 50 and left-hand and right-hand outer portions 52 and 53. The projection 42 or second connecting means has an inner portion 55 and an outer portion 56 disposed aligned along the plane 47. The outer portion 52 of the bridge means and the inner portion 55 of the projection 42 are contiguous and inclined at an angle 57 to each other at a left rigid joint 59, the angle 57 being measured between an undesignated centreline of the outer portion 52 and the plane 47. Similarly, the right second connecting means 39 has a right projection 61 having a projection plane 62 similarly inclined at an angle 63 to the bridge means at a right rigid joint 65. The angles 57 and 63 are equal to each other and thus the nosepiece has a pair of projections 42 and 61 inclined to each other at an included angle 66; shown undeformed in FIG. 3. Thus, the projection 42 and the complementary socket means 45 are inclined generally steeply relative to the respective lens. That is, the socket opening located in the peripheral rim extending around an edge of the respective lens is inclined generally steeply relative to a plane of the respective lens defined by the edge of the lens.

As will be described, the nosepiece is relatively stiff, but is designed to be selectively deformed adjacent the central portion 50, whereas essentially zero deformation takes place at the rigid joints 59 and 65. Thus, the rigid joints 59 and 65 provide a relatively stiff connection between the nosepiece and eyepieces to control relative inclination and orientation of the eyepieces with respect to each other. The rigid joints 59 and 65 are therefore sufficiently stiff to resist local deformation when the nosepiece is subjected to normal loads occurring during use. Thus, the angles 57 and 63 between the second connecting means and the outer portions of the bridge means remain essentially unchanged during normal use. However, flexibility of the nosepiece at the central portion 50 of the bridge means results in changes to the included angle 66 to accommodate faces of different shapes. Also, in FIG. 6, it is seen that the projection planes 47 and 62 are spaced equally from and are almost parallel to the main plane of symmetry 40 when in a relaxed condition. As seen in FIG. 1, to accommodate tapering of a wearer's nose, undesignated side edges of the nosepiece 15 taper upwardly and inwardly as is common practice, and consequently, the projection planes 47 and 62 are similarly inclined at undesignated very shallow angles to the main plane of symmetry 40. However, as will be described, when connecting and disconnecting the nosepiece from the eyepieces, flexibility is sufficient to permit the projection planes to be twisted slightly to be more or less parallel with each other.

Figure 4:
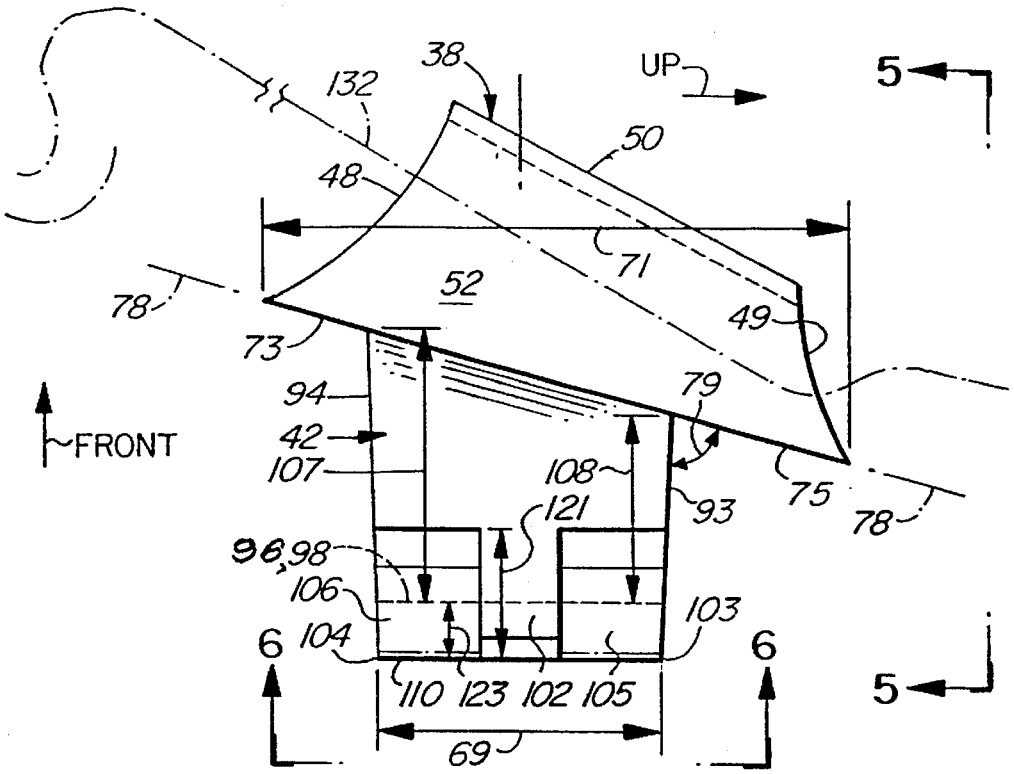
FIG. 4 is a side elevation of the nosepiece as used to interconnect eyepieces together.
Figure 5:
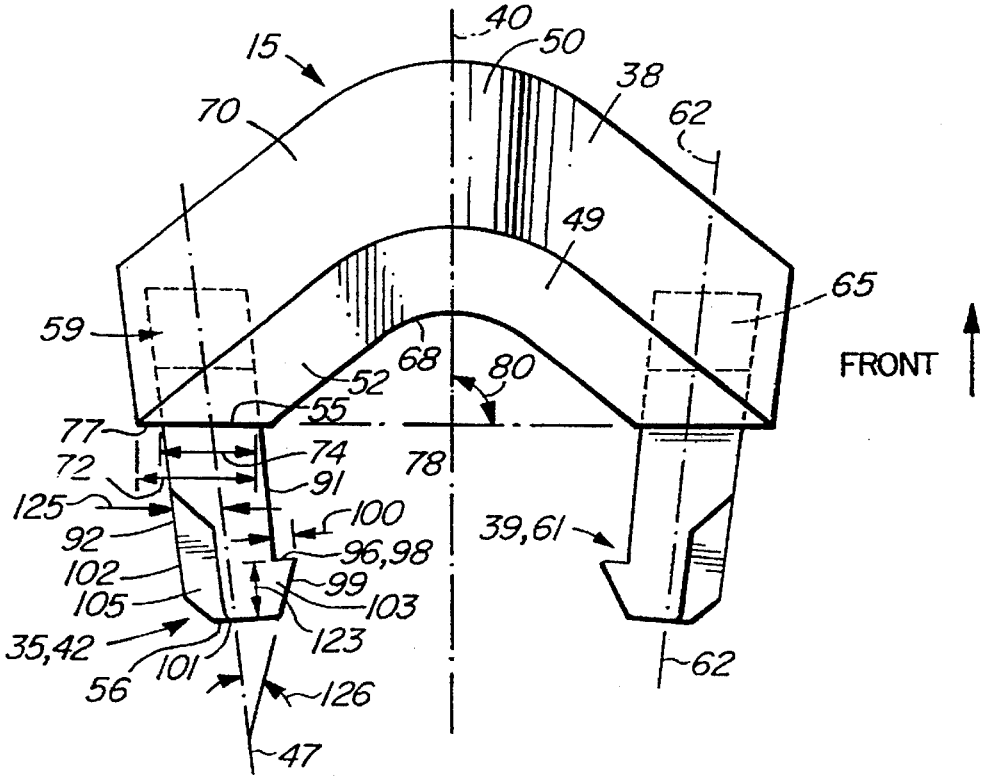
FIG. 5 is a simplified top plan of the nosepiece as seen from line 5—5 of FIG. 4.

Referring to FIGS. 4 and 5, the left-hand projection 42 has oppositely disposed first and second broad faces 91 and 92 respectively, which are disposed generally parallel to the projection plane 47 and spaced apart to define local transverse thickness 74 of the inner portion 55. The faces 91 and 92 are inwardly and outwardly facing faces of the projection. The projection 42 has oppositely disposed upper and lower narrow faces 93 and 94 respectively, which define axial width 69 of the projection and provide a projection having an elongated rectangular cross-section, best seen in FIG. 6. The axial width 69 of the left projection 42 is thus measured parallel to the projection plane 47 of FIGS. 3 and 5. The left outer portion 52 of the bridge means has a width 71 which is local spacing between the edges 48 and 49 and is greater than the width 69 of the adjacent projection inner portion 55. Thus, the upper and lower narrow faces of each projection are disposed inwardly from the upper and lower edges of the adjacent outer portion of the bridge means to provide a lower engaging shoulder 73 and an upper engaging shoulder 75. The upper and lower shoulders 75 and 73 extend upwardly and downwardly from the upper and lower narrow faces 93 and 94 respectively of the projection 42, and are co-planar with each other and disposed on opposite sides of the projection. Also, as seen in FIGS. 3 and 5, the outer portion 52 of the bridge means has a local transverse thickness 72 defined by local spacing between inner and outer surfaces 68 and 70 of the bridge means. The thickness 72 is greater than the adjacent local transverse thickness 74 of the projection inner portion 55, thus providing an outer engaging shoulder 77 extending between the outer surface 70 of the bridge means and an adjacent outwardly facing face, ie: the second face 92, of the projection 42.

The shoulders 73, 75 and 77 are generally co-planar with each other and are disposed within a shoulder plane 78. As seen in FIG. 4, the shoulder plane 78 is inclined at a slant angle 79 to the projection 42, which angle tends to slant the lens upwardly and backwardly when worn on the face. When the nosepiece is undeformed as shown in FIGS. 3 and 5, the shoulder plane 78 is inclined at an angle 80 to the main plane of symmetry 40. The angle 80 is usually about 90 degrees, and thus the plane 78 is generally perpendicular to the main plane of symmetry 40. When the goggles are worn on a face, the nosepiece is deformed and the plane 78 can be at an angle different than 90 degrees. Clearly, when undeformed, a corresponding shoulder plane of the right connecting means 39 is coplanar with the left shoulder plane 78.

Referring to FIG. 3, the peripheral rim 18 has the socket means 45 which is a socket opening defined at one end by an opening rim portion 86 extending therearound on the outer face 19 of the peripheral rim 18, i.e. on a side of the eyepiece adjacent the lens 17. The opening rim portion is generally plane and thus is complementary to the engaging shoulders 73, 75 and 77 of the bridge means, so as to assist in reducing movement between the nosepiece and the respective eyepiece as will be described. While the shoulders 73, 75 and 77 are generally co-planar and the opening rim portion 86 is shown as generally planar, absolute flatness is not required but a smooth continuity of the surfaces of the shoulders 73, 75 and 77 is preferred. A very shallow curve is acceptable instead of an arcuate plane or flat surface. Similarly, the rim portion 86 can be very slightly curved, provided it is generally complementary to the shoulders 73, 75 and 77, which assist in maintaining a snug fit between the nosepiece and the eyepieces as will be described. In particular, for aesthetic purposes, an outer sharp edge of the outer shoulder 77 should be a snug fit against the adjacent rim portion, so as to improve appearance of the goggles, as well as augmenting retention of the projection within the socket opening as will be described.

Referring to FIG. 5, the first broad face 91 has a forward facing transverse step 96 thereon which has an engaging edge 98 extending between the narrow faces 93 and 94. The transverse step 96 is one portion of a latch means and has a width 100, which is between 0.2 mm and 0.5 mm and represents distance of the engaging edge 98 from the first broad face 91. The step 96 has an outer portion 99 extending from the engaging edge 98 to an outer end face 101 of the projection 42. It can be seen that the step 96 is located on one broad face of the particular projection, ie: the first face 91, and the outer shoulder 77 is adjacent an oppositely facing broad face of the projection, that is the second face 92, and the bridge means. As will be described, the benefits of the invention are best achieved by locating the step 96 of the latch means on an opposite side of the projection from the corresponding outer shoulder.

In FIGS. 4 and 5, the second broad face 92 of the projection 42 has an axially extending central rib 102 disposed between a pair of clearance portions 105 and 106 which extend from the rib to the adjacent narrow faces 93 and 94 respectively. The clearance portions 105 and 106 are disposed on opposite sides of corresponding outer corner portions 103 and 104 respectively. The clearance portions have an axial length 121 which is approximately twice as long as width 123 of the outer portion 99 of the transverse step 96. The clearance portion has a depth 125 which is approximately one half of the transverse width 74 of the end face 101 as measured at the rib 102. Thus, the rib has the clearance portions on opposite sides thereof, and can serve as a fulcrum or spacer means to permit rocking or deformation of the outer corner portions 103 and 104 of the projection as will be described.

Referring to FIG. 3, the socket opening 45 has inner and outer ends 110 and 111 respectively adjacent the faces 19 and 28 of the rim 18. The socket opening has first and second broad faces 115 and 116 respectively, the first face having a rearward facing latch shoulder 119 extending transversely across the face, the latch shoulder being generally adjacent the outer end 111 of the socket opening. The transverse step 96 of the first face of the projection 42 is positioned on the face 91 to cooperate with the latch shoulder 119 of the socket opening when the projection is fully received in the socket as shown in FIG. 3. As shown in FIG. 4, the transverse step 96 is spaced from the lower and upper engaging shoulders 73 and 75 by corresponding lower and upper step spacings 107 and 108. The step spacings 107 and 108 are essentially equal to corresponding shoulder spacings between the latch shoulder 119 and axially aligned corresponding portions of the opening rim portion 86. As seen in FIG. 3, at a particular location on the projection, a corresponding shoulder spacing 118 is shown between the shoulder 119 and the opening rim portion 86 for the specific plane of section on FIG. 3. The rim portion 86 is in contact with the shoulder 77 of the bridge means, and thus it can be seen that the step of the projection is spaced from the adjacent engaging shoulder of the bridge means by a local step spacing which is essentially equal to a corresponding local shoulder spacing between the latch shoulder 119 and axially aligned corresponding portion of the opening rim portion 86. This is to provide an axially aligned interference fit between the oppositely facing shoulder and the step so as to augment retention of the projection within the recess.

The first and second broad faces 91 and 92 of the projection 42 and the corresponding first and second broad faces 115 and 116 of the socket opening 45 have complementary slight tapers of between about 1 and 3 degrees tapering downwardly from the inner portion 55 to the outer portion 56 of the projection. The narrow faces 93 and 94 of the projection and corresponding undesignated narrow faces of the socket opening 45 have similar slight tapers extending from the inner portion to the outer portion. Thus, as the projection enters the socket opening, the complementary faces become closer towards each other until a transversely aligned interference fit is achieved when the step 96 fully engages the latch shoulder 119.

Figure 7:
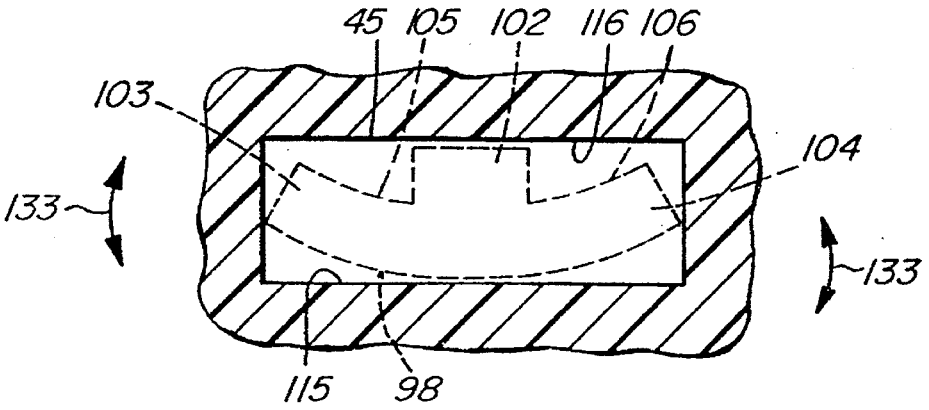
FIG. 7 is a simplified fragmented view similar to FIG. 6 showing a portion of an eyepiece socket and deformation of the nosepiece during connection with or disconnection from the eyepiece deformation of portions of the nosepiece and some dimensions being exaggerated for clarity.

As best seen in FIG. 7, the central rib 102 of the second face 92 of the projection contacts the second broad face 116 of the socket opening 45, and it can be seen that the clearance portions 105 and 106 provide clearance for the outer corner portions 103 and 104 from the second face 116. The clearance portions on opposite sides of the rib permit the outer corner portions 103 and 104 of the projection to be deformed relative to the ribs 102 as shown in broken outline. Thus, the outer portion of the projection is deformed with respect to the socket means 54 so that the rib 102 effectively provides a spacer or fulcrum. This deformation facilitates engagement and disengagement of the step of the projection with the shoulder of the socket opening for assembly and disassembly of the goggles.

Preferably, the outer portion of the step 99 is generally parallel to the main plane of symmetry 40 of the nosepiece, and thus is inclined at a taper angle 126 to the second broad face 91 of the projection. The taper angle facilitates initial insertion of the outer portion 56 of the projection 42 into the socket opening 45, and facilitates disassembly by providing a clearance gap 135 for a tool, eg. a knife blade, as well as simplifying manufacturing of the items.

Figure 6:
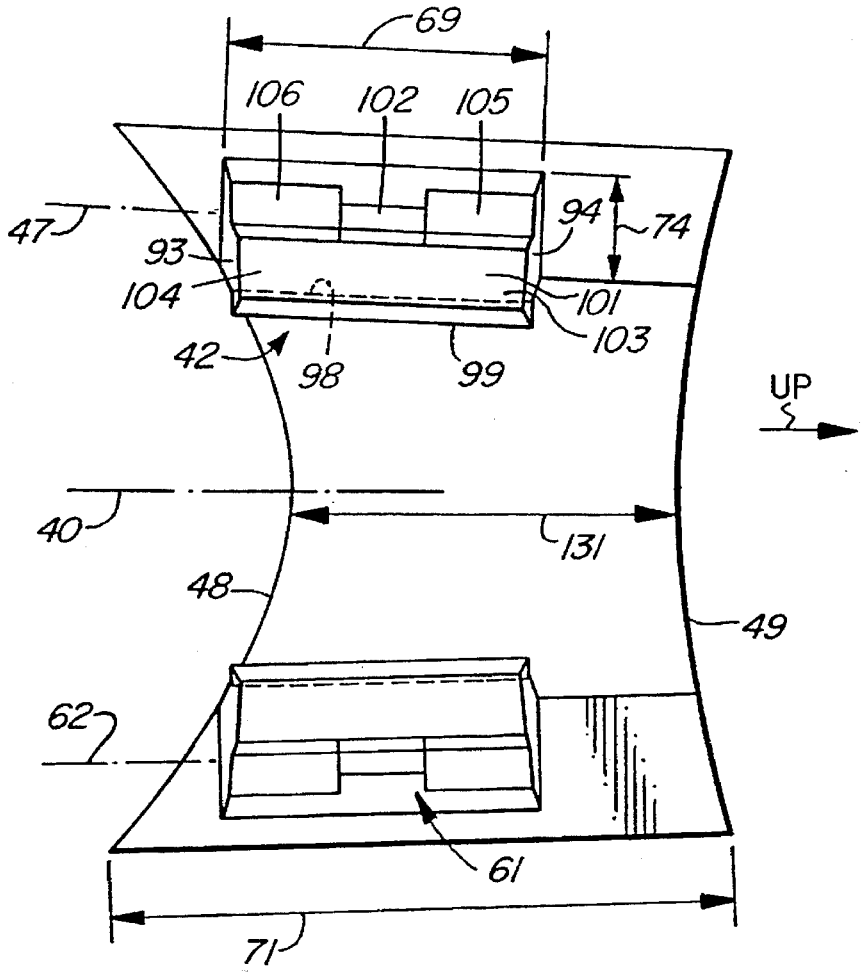
FIG. 6 is a rear elevation of the nosepiece, as seen from line 6—6 of FIG. 4.

As seen in FIG. 6, the central portion of the bridge means has a width 131 which is considerably narrower than the width 71 at the outer portion of the bridge means, the width 131 being local spacing between the edges 48 and 49 of the bridge means. Also, as seen in FIG. 3, the central portion 50 of the bridge has a thickness 129 (typically about 1–3 mm) which is less than thickness of the outer portions 52 and 53 of the bridge means (typically about 3–5 mm). Thus, when the goggles are assembled and subjected to bending or twisting, essentially all deflection will occur adjacent the central portion 50, thus relieving the rigid joints 59 and 65 from excessive forces so as to maintain a stiff connection therebetween. As seen in FIGS. 3 and 4, the bridge means has a relatively deep U-shape, and as such extends some distance from the wearer's nose, shown in broken outline at 132. The width and stiffness of the central portion 50, and its clearance from the wearer's nose 132, provides protection against injury resulting from impingement with a ball which can occur in racket sports. The stiffness of the bridge is generally sufficient to transfer any impact forces from the bridge into the frame of the goggles, by passing through the relatively broad surface area of the engaging shoulder means and peripheral rim. Force is then transferred through the frame and padding 27 onto the face bones surrounding the eye, thus relieving the nose and eye of force from the ball, or other impact.

The eyepieces and nosepieces are preferably fabricated in cavity injection dies, and because the nosepiece is distinct and separate from the eyepieces, materials that are best to withstand the forces imposed on the nosepiece are selected for the nosepiece, and materials for the eyepiece are selected for best optical qualities. Thus, there is no compromise on material characteristics for the two main components of the invention, which contrasts with the integrally moulded goggles of the prior art, and yet the comfort and sealing benefits of the rigidly connected eyepieces are obtained.

Preferably, the nosepiece is selected from a high impact nylon material, eg. Type 11 or 12 nylon, or DuPont Super Tough Nylon, or Zytel (trade-mark) nylon, as manufactured by DuPont. These plastics are in a family of polyamide thermoplastic resins which have some main physical characteristics as recited below.

| Property | ASTM (Test Method) | Range of Values |
|---|---|---|
| Tensile strength at break, PSI | D638 | 5100–10,000 |
| Elongation at break, percentage | D638 | 250–400 |
| Tensile yield strength, PSI | D638 | 3000–6100 |
| Flexural strength (rupture or yield) PSI | D790 | 1400–8100 |
| Hardness (Rockwell) | D785 | R70–R109 |
| Hardness (Shor/Barcol) | D2240/D2583 | D58–D75 |
| Izod impact (−40° C. through +30° C.) (J/m) | D256A | 160–907 |

In contrast, the peripheral rim of the eyepiece is manufactured from a material such as a polycarbonate, and the lens 17 can be integral with the rim, or can be a separate material eg. an optically treated polycarbonate bonded into the peripheral rim. Because the rims are not subjected to particular high stresses, the rim and eyepiece can be fabricated from a single piece of material selected for its optical characteristics.

Operation

To assemble the goggles from two separate eyepieces and one nosepiece, the outer portion 56 of the left projection 42 is positioned over the socket opening 45 of the left eyepiece 12. The slight taper angle 126 of the outer portion of the step 99 facilitates initial entry of the outer portion 51 into the socket opening 45, and this is followed by relatively vigorous pushing of the projection 42 into the socket opening to overcome the increasing resistance of the interference fit between the engaging edge 98 of the step 96 and the broad face 115 as the projection is pushed inwardly between the broad faces 115 and 116 of the socket opening. The resistance increases and approaches a maximum as the engaging edge 98 approaches the shoulder 119. To complete engagement of the edge 98 with the step 96, it can be helpful to produce slight rotary oscillations or rocking between the connecting portion and the socket opening as shown in FIG. 7 by an arrow 133. This slight rocking causes slight twisting deformation of the outer portion 56 of the projection with respect to the socket opening 45, the corner portions 103 and 104 being deformed as shown in broken outline due to the clearance portions 105 or 106. As the outer end face 110 of the projection approaches the outer end 111 of the socket opening 45, the engaging edge 98 of the step passes the latch shoulder 119, the portions "snap" together, at which time the upper and lower engaging shoulders 73 and 75 and the outer shoulder 77 engage the opening rim portion 86 extending around the socket opening.

As previously described, the width 131 of the central portion 50 of the bridge means is considerably narrower than the width 71 of the outer portions of the bridge means. Thus, when the nosepiece is installed in both eyepieces, any bending forces applied to the nosepiece 15 will result in higher stresses adjacent the central portion 50 of the nosepiece, which tend to produce local bending adjacent the plane 40, rather than adjacent the rigid joint 59 or 65. Thus, for example when placing the goggles over the face, when tensile and bending loads are applied to the nosepiece, bending will tend to occur selectively adjacent the central portion 50 as opposed to bending adjacent the rigid joint between the projection and the bridge means. Consequently, the angles 57 and 63 between the outer portions of the bridge means and the inner portions of the projections will remain essentially unchanged.

Thus, the connection between the nosepiece and the eyepieces will have considerably higher stiffness than the normal relatively loose band connection of the prior art, and will tend to be close to the stiffness between the nosepieces and the eyepieces of the integral one piece goggles of the prior art. Thus, the stiffness found in the one piece prior art goggles will be generally attained with the present invention, which assists in maintaining eyepiece alignment, which in turn tends to reduce leakage between the gasket 27 sealing the wearer's face.

To separate the nosepiece from the eyepieces, a thin knife blade, not shown, is inserted into the gap 135 between the outer portion 99 of the stop 96 and a recessed portion 137 of the face 115 adjacent the outer end 111 of the socket opening. The knife blade is inserted into the gap 135 adjacent one of the narrow edges 93 or 94 of the projection 42, and twisted between about 10 and 45 degrees to deflect an outer corner portion 103 or 104 of the projection 42 due to the clearance opening 105 or 106 on an opposite side thereof. This deflection permits one end of the transverse step 96 to slidably disengage from the latch shoulder 119, so that the outer corner portion assumes the broken outline position as shown in FIG. 7. The knife blade can then be inserted into a corresponding gap adjacent an opposite narrow edge of the outer portion, thus similarly deflecting that opposite outer corner portion, to permit full disengagement of the transverse step 96 and the latch shoulder 119. When the latch shoulder and step are fully disengaged, the projection 42 can be fully withdrawn from the socket means 45, causing minimal damage to the engaging edge 98 of the step.

In summary, the effectiveness of the connection between the nosepiece and eyepieces is attributed to the two types of interference fit, namely a generally axially aligned fit due to oppositely facing surfaces at opposite ends of the projections and socket openings, and a transverse fit due to the complementary tapers of the projections and socket openings. These two fits result in an essentially non-yielding connection, but the connection is relatively easy to disengage when needed. These advantages result from the bridge means having an engaging shoulder adapted to engage the peripheral rim of the eyepiece, and the latch means having a step located on the projection, and a latch shoulder extending into the socket means. The step and latch shoulder are engageable with each other when the projection is fully received in the socket means, so as to hold the engaging shoulder of the bridge means against the peripheral rim of the eyepiece in an interference fit to augment retention of the projection within the socket opening.

This fit can best be attained by having the step of a particular projection located on one broad face of the particular projection, and the corresponding engaging shoulder adjacent an oppositely facing broad face of the said projection. Preferably the first broad face of the projection having the step faces inwardly towards the opposite projection, the second broad face facing outwardly. The engaging shoulder includes an outer shoulder disposed between an outer portion of the bridge means and the second broad face. The socket opening has a pair of oppositely facing first and second broad faces, the first face having the latch shoulder facing outwardly of the eyepiece, and adapted to engage the step. The opening rim portion of the socket opening engages the outer shoulder of the bridge means on a side of the socket opening opposite to the latch shoulder. In this way, pairs of engaging surfaces on opposite sides of the projection and socket opening are held in intimate contact with each other to augment retention of the projection within the socket means, and yet permit disengagement of the latch means.

Also, it can be seen that each latch means is resiliently deformable and is adapted to temporarily deform from an initial unstrained extended position to a strained retracted position as the projection is inserted into or removed from the respective socket. The latch means resiliently moves towards the said initial unrestrained extended position after complete insertion into the socket to hold the step 96 in engagement with the shoulder 119.

I claim:

1. Eye goggles comprising:

(a) a pair of eyepieces, each eyepiece having a lens and a peripheral rim extending around an edge of the lens, the edge of the lens defining a plane of the lens, each peripheral rim having a head strap connecting means to receive a head strap, and a socket opening located in the peripheral rim of the respective eye piece and inclined generally steeply relative to the plane of the respective lens, and (b) a nosepiece having a pair of essentially straight projections and a bridge means disposed between and integral with the projections, each projection of said nosepiece having a projection inner portion; said bridge means having outer portions adjacent the projection inner portions; and at least a portion of each projection of said nosepiece is received in and is generally complementary to a respective socket opening, the projection inner portions of said nosepiece and said outer portions of the bridge means being contiguous and inclined at respective angles to each other at an essentially rigid joint which is sufficiently stiff to resist deformation when subjected to normal loads occurring during use so that the said angles between the projections and the outer portions of the bridge means remain essentially unchanged during normal use, each outer portion of the bridge means having a size greater than the adjacent projection inner portion to provide an engaging shoulder to engage the peripheral rim of the respective eyepiece, so that the projections and the socket openings engage each other, and the engaging shoulders and the peripheral rims engage each other to restrict relative rotation between the outer portions of the bridge means and the peripheral rim sufficiently to provide a secure, essentially non-yielding joint between the bridge means and the eyepieces.

2. Goggles as claimed in claim 1, in which:

(a) each projection has a respective projection outer portion disposed about a respective projection plane containing the projection inner portion so that each projection inner portion and respective projection outer portion are generally aligned with each other, and (b) each outer portion of the bridge means has a width which is greater than width of the adjacent projection inner portion so as to provide said engaging shoulder to engage the peripheral rim of the eyepiece, the said widths being as measured parallel to the projection plane.

3. Goggles as claimed in claim 2, in which:

(a) the socket opening of each eyepiece has an opening rim portion extending therearound on a side of the eyepiece adjacent the lens, and (b) the engaging shoulder of the bridge means is generally complementary to a portion of the opening rim portion so as to assist in reducing movement between the nosepiece and eyepieces.

4. Goggles as claimed in claim 3 in which:

a) the opening rim portion is generally plane and, b) the engaging shoulder is similarly generally plane.

5. Goggles as claimed in claim 3 in which:

a) each projection has faces which taper slightly from the inner portion of the projection to the outer portion of the projection, b) each socket opening has faces which taper slightly from adjacent the opening rim portion to an outer end of the socket opening, taper of the faces of the socket opening being complementary to the taper of the faces of the respective projection to augment retention of the projection within the socket opening.

6. Goggles as claimed in claim 2 in which:

a) each projection has oppositely disposed first and second broad faces and oppositely disposed upper and lower narrow faces, space between the narrow faces defining the width of the projection, b) the bridge means has upper and lower edges, local spacing between the said edges at the outer portions of the bridge means defining the width of the outer portions of the bridge means, c) said upper and lower narrow faces of each projection being disposed inwardly from the upper and lower edges of the adjacent outer portion of the bridge means to provide upper and lower engaging shoulders extending outwardly from the upper and lower narrow faces respectively of each projection.

7. Goggles as claimed in claim 6, in which:

(a) the upper and lower engaging shoulders adjacent each outer portion of the bridge means are generally coplanar with each other, and (b) each socket opening has a generally plane opening rim portion extending therearound, the opening rim portion being generally complementary to the upper and lower engaging shoulders.

8. Goggles as claimed in claim 6 in which:

a) spacing between the first and second broad faces of each projection inner portion defines transverse thickness of the said inner portion, b) the outer portion of the bridge means has inner and outer faces which are spaced apart at a spacing which defines local thickness of the outer portions of the bridge means, which thickness is greater than the transverse thickness of the inner portion of the projection to provide an outer engaging shoulder extending between the outer face of the bridge means and an adjacent outer face of the outwardly facing projection.

9. Goggles as claimed in claim 8, in which:

(a) the said upper, lower and outer engaging shoulders extend between adjacent portions of each projection and the bridge means and are generally coplanar with each other, and (b) each socket opening has a generally plane opening rim portion extending therearound on a side of the eyepiece adjacent the lens, the rim being generally complementary to said upper, lower and outer engaging shoulders.

10. Goggles as claimed in claim 1 in which:

a) the bridge means has upper and lower edges, local spacing between the edges defining local width of the bridge means, the bridge means being narrower adjacent a central portion thereof than outer portions thereof.

11. Goggles as claimed in claim 1, further including:

(a) latch means for restricting separation of each projection from the respective socket opening, each projection and respective socket opening having a respective latch means cooperating therewith.

12. Goggles as claimed in claim 11, in which:

(a) each latch means includes a step located on the projection, and a latch shoulder extending into the socket opening, the step and latch shoulder being engageable with each other when the projection is fully received in the socket opening, so as to hold the engaging shoulder against the peripheral rim of the eyepiece in an interference fit to augment retention of the projection within the socket opening.

13. Goggles as claimed in claim 12 in which:

a) each latch means is resiliently deformable and is adapted to temporarily deform from an initial unstrained extended position to a strained retracted position as the projection is inserted into or removed from the respective socket opening, the latch means then resiliently moving towards the said initial unrestrained extended position after complete insertion into the socket opening.

14. Goggles as claimed in claim 13, in which:

(a) each socket opening has an opening rim portion extending therearound on a side of the eyepiece adjacent the lens, the socket opening having inner and outer ends, the inner end of the socket opening being adjacent the socket rim, and the outer end of the socket opening having said latch shoulder facing in one direction, and (b) each projection comprises oppositely disposed first and second broad faces disposed generally parallel to a respective, projection plane, the first broad face having said step thereon facing in a direction opposite to the latch shoulder of the socket opening and positioned to cooperate with the latch shoulder of the socket opening to form the latch means, and the second broad face having clearance means for permitting deformation of the outer portion of the projection to facilitate engagement and disengagement of the latch shoulder from the step.

15. Goggles as claimed in claim 14 in which:

a) each socket opening has a pair of oppositely facing first and second broad faces, the first broad face having the latch shoulder extending transversely across at least a portion of the first face, b) the said step extends transversely across at least a portion of the first broad face of the respective projection, and the second face of each projection has an axially extending centrally located rib disposed between a pair of clearance portions, the rib being adapted to contact the second broad face of the socket opening to provide a fulcrum about which the projection can deform with respect to the socket opening, so as to facilitate engagement and disengagement of the step of the projection with the shoulder of the socket opening.

16. Goggles as claimed in claim 14 in which:

a) the step of each projection is spaced from the adjacent axially aligned engaging shoulder of the bridge means by a local step spacing, which spacing is essentially equal to a corresponding local shoulder spacing between the latch shoulder and an adjacent axially aligned portion of the opening rim portion, to provide an interference fit between the oppositely facing engaging shoulder and the step to augment retention of the projection within the socket opening.

17. Goggles as claimed in claim 16 in which:

a) the step of each projection is located on the first broad face of the said projection, and the corresponding engaging shoulder is adjacent the second broad face of the said projection.

18. Goggles as claimed in claim 16, in which:

(a) the first broad face of the projection having the step is facing inwardly and towards the opposite projection, and the second broad face is facing outwardly in an opposite direction, (b) said engaging shoulder includes an outer engaging shoulder disposed between an outer portion of the bridge means and the second broad face, (c) each socket opening has a pair of oppositely facing first and second broad faces, the first broad face having the latch shoulder facing outwardly of the socket opening to engage the step, and (d) the opening rim portion of the socket opening engages the outer engaging shoulder of the bridge means on a side of the socket opening opposite to the latch shoulder, so that pairs of surfaces on opposite sides of the projection and the respective socket opening are held in intimate contact with each other to augment retention of the projection within the socket means, and yet permit disengagement of the latch means.

19. Eye goggles comprising:

(a) a pair of eyepieces, each eyepiece having a lens and a peripheral rim extending around the lens, each peripheral rim having a first connecting means and a headstrap connecting means to receive a headstrap, each first connecting means of the eyepieces being a socket means located in the peripheral rim of the respective eye piece, (b) a nosepiece having a pair of second connecting means and a bridge means disposed between and integral with the second connecting means, the bridge means having an engaging shoulder adapted to engage the peripheral rim of the eyepiece, each second connecting means being complementary to a respective first connecting means of the pair of eyepieces, inner portions of the second connecting means and outer portions of the bridge means being contiguous and inclined at respective angles to each other at a rigid joint which is sufficiently stiff to resist deformation when subjected to normal loads occurring during use, so that the said angles between the second connecting means and the outer portions of the bridge means remain essentially unchanged during normal use, each second connecting means of the nosepiece being an essentially straight projection, and (c) at least one of the connecting means of a complementary pair of connecting means further includes a latch means for restricting separation of the connecting means of each pair, the latch means including a step located on the projection, and a latch shoulder extending into the socket means, the step and latch shoulder being engagable with each other when the projection is fully received in the socket means, so as to hold the engaging shoulder of the bridge means against the peripheral rim of the eyepiece in an interference fit to augment retention of the projection within the socket opening.

20. Eye goggles comprising:

a) a pair of eyepieces, each eyepiece having a lens and a peripheral rim extending around the lens, each peripheral rim having a first connecting means and a headstrap connecting means to receive a headstrap, each first connecting means of the eyepieces being a socket means located in the peripheral rim of the respective eyepiece, the peripheral rim of the each eyepiece having a socket opening therein to serve as the socket means, the socket opening having an opening rim portion extending therearound on a side of the eyepiece adjacent the lens, the socket opening having faces which taper slightly from adjacent the opening rim portion to an outer end of the socket opening, b) a nosepiece having a pair of second connecting means and a bridge means disposed between and integral with the second connecting means, the bridge means having an engaging shoulder adapted to engage the peripheral rim of the eyepiece, each second connecting means being complementary to a respective first connecting means of the pair of eyepieces, inner portions of the second connecting means and outer portions of the bridge means being contiguous and inclined at respective angles to each other at a rigid joint which is sufficiently stiff to resist deformation when subjected to normal loads occurring during use, so that the said angles between the second connecting means and the outer portions of the bridge means remain essentially unchanged during normal use, each second connecting means of the nosepiece being an essentially straight projection, each projection of the second connecting means having the projection inner portion and a projection outer portion disposed about a respective projection plane so as to be generally aligned with each other, and each outer portion of the bridge means having a width which is greater than width of the adjacent projection inner portion, so as to provide at least one engaging shoulder to engage the peripheral rim of the eyepiece, the engaging shoulder of the bridge means being complementary to a portion of the opening rim portion so as to assist in reducing movement of the nosepiece and the eyepieces, each projection having faces which taper slightly from the inner portion of the projection to the outer portion of the projection, the taper of the faces of the socket opening being complementary to the taper of the faces of the respective projection to augment retention of the projection within the socket opening.

21. Eye goggles comprising:

(a) a pair of eyepieces, each eyepiece having a lens and a peripheral rim extending around the lens, each peripheral rim having a first connecting means and a headstrap connecting means to receive a headstrap, each first connecting means of the eyepieces being a socket means located in the peripheral rim of the respective eye piece, the peripheral rim of each eyepiece has a socket opening therein to serve as the socket means, the socket opening having an opening rim portion extending therearound on a side of the eyepiece adjacent the lens, the socket opening having inner and outer ends, the inner end being adjacent the socket rim, b) a nosepiece having a pair of second connecting means and a bridge means disposed between and integral with the second connecting means, the bridge means having an engaging shoulder adapted to engage the peripheral rim of the eyepiece, each second connecting means being complementary to a respective first connecting means of the pair of eyepieces, inner portions of the second connecting means and outer portions of the bridge means being contiguous and inclined at respective angles to each other at a rigid joint which is sufficiently stiff to resist deformation when subjected to normal loads occurring during use, so that the said angles between the second connecting means and the outer portions of the bridge means remain essentially unchanged during normal use, each second connecting means of the nosepiece being an essentially straight projection, the projection of each second connecting means has oppositely disposed first and second broad faces disposed generally parallel to the respective projection plane, (c) at least one of the connecting means of a complementary pair of connecting means further includes a latch means for restricting separation of the connecting means of each pair, each latch means being resiliently deformable and adapted to temporarily deform from an initial unstrained extended position to a strained retracted position as the projection is inserted into or removed from the respective socket, the latch means then resiliently moving towards the said initial unstrained extended position after complete insertion into the socket, the outer end of the socket opening having a latch shoulder, and the first face of the projection having a step thereon positioned to cooperate with the latch shoulder of the socket opening to form the latch means, the second face having clearance means for permitting the said deformation of the outer portion of the projection to facilitate engagement and disengagement of the latch shoulder from the step.

* * * * *